US008466359B2

(12) United States Patent
Sakai

(10) Patent No.: US 8,466,359 B2
(45) Date of Patent: Jun. 18, 2013

(54) PEDAL DEVICE

(75) Inventor: Kimio Sakai, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 8 days.

(21) Appl. No.: 13/227,598

(22) Filed: Sep. 8, 2011

(65) Prior Publication Data

US 2012/0060671 A1 Mar. 15, 2012

(30) Foreign Application Priority Data

Sep. 10, 2010 (JP) ..... 2010-203673

(51) Int. Cl.
*G10C 3/26* (2006.01)

(52) U.S. Cl.
USPC ..... 84/225; 84/229; 84/746

(58) Field of Classification Search
USPC ..... 84/225, 229, 746
See application file for complete search history.

(56) References Cited

U.S. PATENT DOCUMENTS

| | | | | |
|---|---|---|---|---|
| 1,011,191 | A * | 12/1911 | Haas | 84/229 |
| 1,085,915 | A * | 2/1914 | Huseby | 84/225 |
| 1,166,964 | A * | 1/1916 | Avisus | 84/225 |
| 4,653,378 | A | 3/1987 | Watanabe et al. | |
| 5,945,616 | A | 8/1999 | Hoshino | |
| 7,405,352 | B2 * | 7/2008 | Dorfman et al. | 84/422.1 |
| 8,288,643 | B2 * | 10/2012 | Komatsu | 84/746 |
| 8,324,488 | B2 * | 12/2012 | Iwamoto et al. | 84/225 |
| 2005/0150367 | A1 * | 7/2005 | Izumi | 84/746 |
| 2009/0205476 | A1 * | 8/2009 | Komatsu | 84/17 |
| 2009/0229440 | A1 * | 9/2009 | Iwamoto et al. | 84/229 |
| 2010/0162873 | A1 * | 7/2010 | Niitsuma | 84/229 |
| 2010/0229711 | A1 * | 9/2010 | Muramatsu et al. | 84/746 |
| 2011/0138987 | A1 * | 6/2011 | Iwamoto et al. | 84/229 |
| 2012/0060671 | A1 * | 3/2012 | Sakai | 84/746 |

FOREIGN PATENT DOCUMENTS

| | | | |
|---|---|---|---|
| CN | 85 1 04830 | A | 7/1986 |
| JP | 61-135392 | U | 8/1986 |
| JP | 61-31359 | Y2 | 9/1986 |
| JP | 5-38690 | U | 5/1993 |
| JP | 07-219542 | A | 8/1995 |
| JP | 09-311682 | A | 12/1997 |
| JP | 10-232670 | A | 9/1998 |
| JP | 2010-113027 | A | 5/2010 |

OTHER PUBLICATIONS

Chinese Office Action dated Jul. 12, 2012 (and English translation thereof) in counterpart Chinese Application No. 201110262481.X.
Japanese Office Action dated Jul. 30, 2012 (and English translation thereof) in counterpart Japanese Application No. 2010-203673.

* cited by examiner

*Primary Examiner* — David Warren
*Assistant Examiner* — Robert W Horn
(74) *Attorney, Agent, or Firm* — Holtz, Holtz, Goodman & Chick, P.C.

(57) ABSTRACT

A pedal device includes a pedal chassis 9 provided in a pedal case 8, a pedal 10 that moves by rotating in the up-down direction with respect to the pedal chassis 9, and a rotation holding mechanism 11 that holds the back portion of the pedal 10 to the pedal chassis 9 such that the back portion of the pedal 10 is movable in the up-down direction. Therefore, when the pedal 10 is depressed, the back portion of the pedal 10 is moved downward by the rotation holding mechanism 11, according to the rotational movement of the pedal 10.

6 Claims, 10 Drawing Sheets

PEDAL DEVICE

CROSS-REFERENCE TO RELATED APPLICATION

This application is based upon and claims the benefit of priority from the prior Japanese Patent Application No. 2010-203673, filed Sep. 10, 2010, the entire contents of which is incorporated herein by reference.

BACKGROUND OF THE INVENTION

1. Field of the Invention

The present invention relates to a pedal device used for a keyboard instrument such as an electronic piano or an electronic organ.

2. Description of the Related Art

Conventionally, keyboard instruments such as electronic pianos are structured to include an instrument case provided with a keyboard section, a leg section supporting the instrument case, and a pedal device which is provided in the leg section and positioned below the instrument case.

As a pedal device of a keyboard instrument such as that described above, a pedal device is known in which a fulcrum hole serving as a fulcrum section is provided in the instrument main body that holds the pedal, and a fulcrum shaft section is provided on the back end portion of the pedal so as to project rearward, as described in Japanese Patent Application Laid-Open (Kokai) Publication No. 07-219542. The fulcrum shaft portion of the pedal is inserted into the fulcrum hole of the instrument main body, whereby the pedal is held so as to rotate in the up-down direction with respect to the instrument main body.

In a conventional pedal device such as this, when the depth of the keyboard section of the electronic piano is shortened and the depth of the instrument case is shortened thereby, the position of the pedal comes too close to the player. Therefore, the pedal is required to be shifted to the back side under the instrument case, or the length of the pedal in the front-back direction is required to be shortened.

However, merely shifting the pedal to the back of the instrument case as in the former instance may cause the pedal device to protrude from the back of the instrument case. Therefore, there is a problem in that the installation space of the overall instrument cannot be reduced even when the depths of the keyboard section and the instrument case are shortened.

Also, when the length of the pedal in the front-back direction is simply shortened as in the latter instance, the lengths of the fulcrum portion of the pedal and the front end portion of the pedal are shortened. Accordingly, when the pedal is depressed and the stroke of the pedal in the downward direction and the stroke of the pedal in the upward direction are the same, the rotation angle in the up-down direction of the pedal increases. Therefore, there is a problem in that the player feels an uncomfortable operational feeling when he or she performs the depressing operation of the pedal, and so cannot perform pedaling operations comfortably.

SUMMARY OF THE INVENTION

An object of the present invention is to provide a pedal device by which an uncomfortable operational feeling is not created during the depressing operation of a pedal and pedaling operations can be performed comfortably even when the installation space of the overall instrument is reduced by the pedal being shortened.

In order to achieve the above-described object, in accordance with one aspect of the present invention, there is provided a pedal device comprising: a pedal that moves by rotating in an up-down direction with respect to an instrument main body; and a rotation holding mechanism that holds a back portion of the pedal to the instrument main body such that the back portion of the pedal is movable in the up-down direction.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

Hereafter, an embodiment in which the present invention has been applied to a keyboard instrument will be described with reference to FIG. 1 to FIG. 10.

Figure 1:
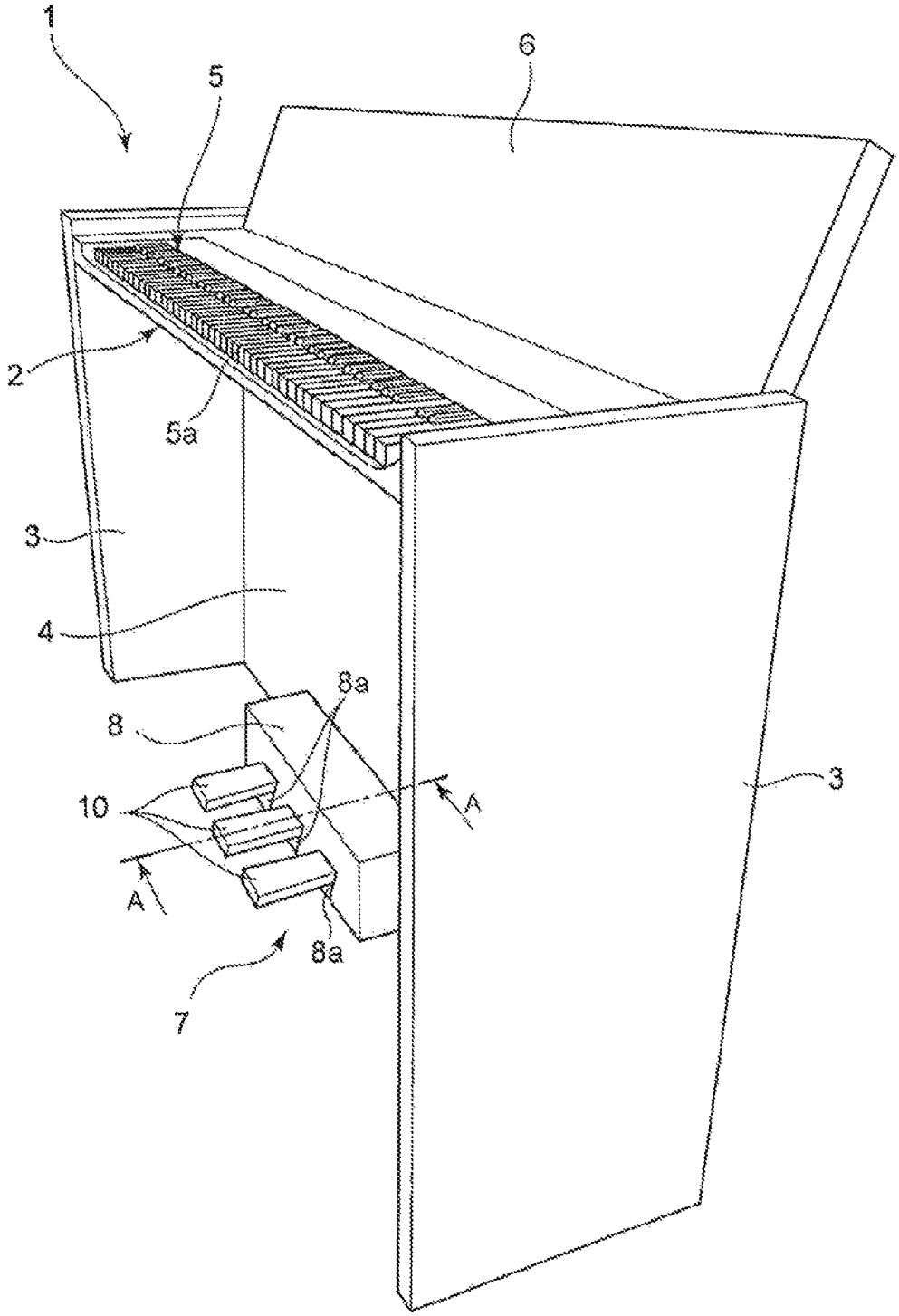
FIG. 1 is a perspective view of an embodiment where the present invention has been applied to a keyboard instrument.

As shown in FIG. 1, the keyboard instrument includes an instrument case 1. The instrument case 1 includes a keyboard box 2, a pair of side boards 3 provided on the left and right sides of the keyboard box 2, and a back surface board 4 provided on the back surface of the keyboard box 2.

As shown in FIG. 1, a keyboard section 5, which is structured such that a plurality of keys 5*a* such as white keys and black keys are arrayed in the order of the musical scale, is provided inside the keyboard box 2. The keyboard box 2 is provided with a keyboard cover 6 that openably and closably covers the keyboard section 5. The pair of side boards 3 and the back surface board 4 also serve as a leg section supporting the keyboard box 2.

Figure 2:
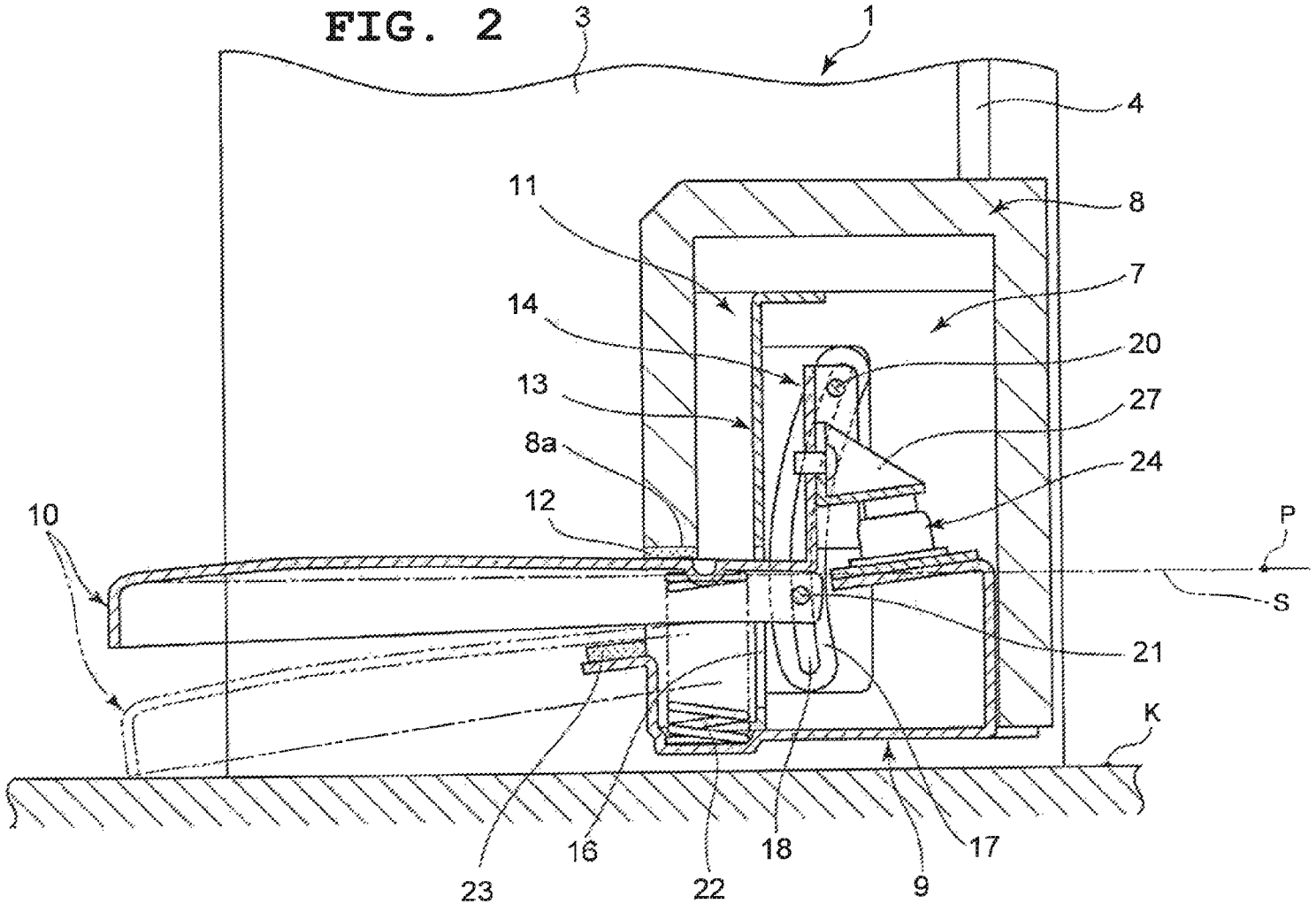
FIG. 2 is an enlarged cross-sectional view of the pedal device of the keyboard instrument which has been taken along line A-A shown in FIG. 1.
Figure 3:
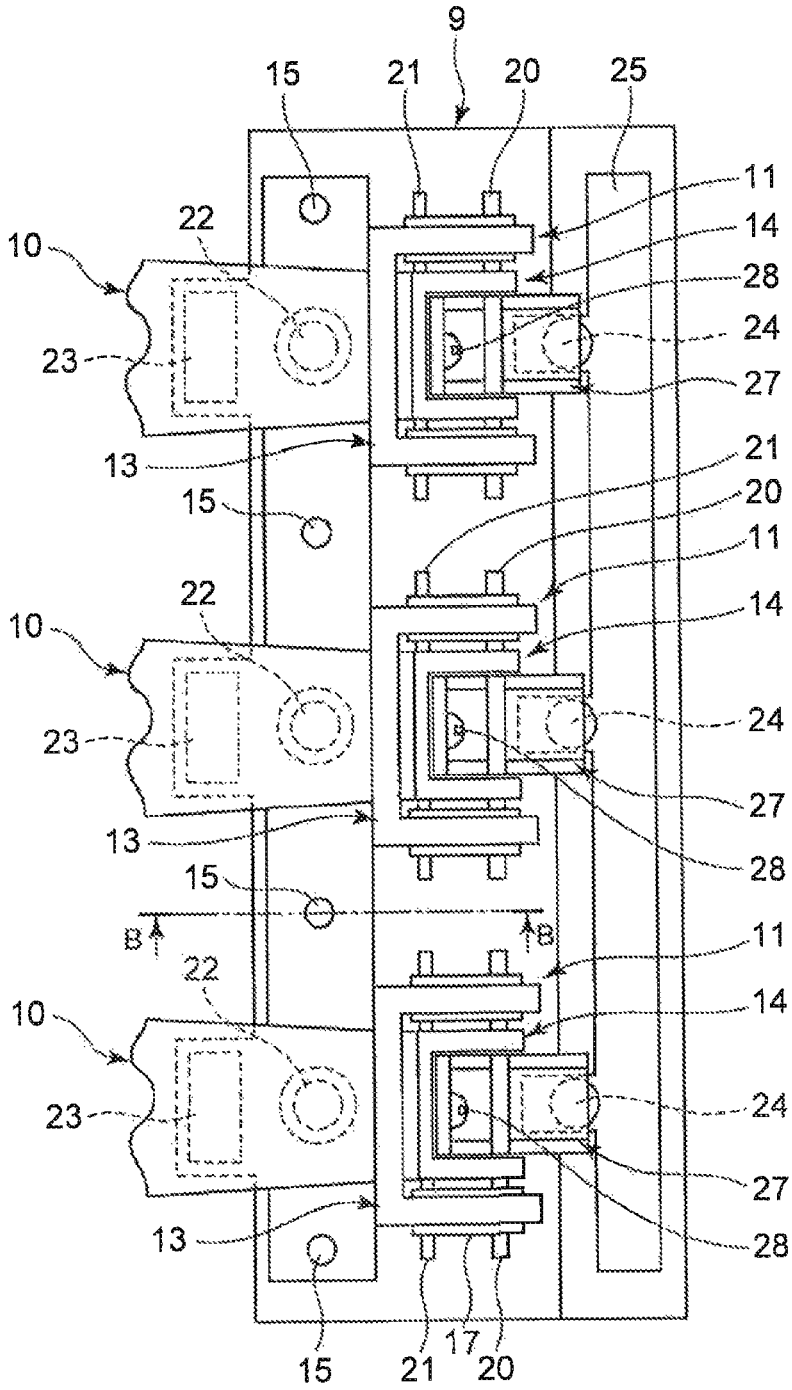
FIG. 3 is an enlarged planar view of the main section of the pedal device shown in FIG. 2, in which the pedal case has been removed.

As shown in FIG. 1, a pedal device 7 is provided in a lower portion inside the keyboard case 1. As shown in FIG. 2 and FIG. 3, the pedal device 7 includes a pedal case 8, a pedal chassis 9 arranged inside the pedal case 8, a plurality of pedals 10 that rotate in the up-down direction with respect to the pedal chassis 9, and a plurality of rotation holding mechanisms 11 that hold the plurality of pedals 10 such that each pedal 10 can move in the up-down direction with respect to the pedal chassis 9.

The pedal case 8 is made of synthetic resin, and arranged on the inner lower portion of the back surface board 4 so as to be positioned below the keyboard box 2, as shown in FIG. 1 and FIG. 2. As shown in FIG. 1 to FIG. 3, the pedal case 8 is formed into a box shape elongated in the left-right direction so that the plurality of pedals 10 can be arrayed in the left-right direction (the up/down direction in FIG. 3 and in the array direction of the keys 5*a* of the keyboard section 5 in FIG. 1) with their back portions (the right side portions in FIG. 2) being inserted into the pedal case 8.

In this instance, as shown in FIG. 1 and FIG. 2, the pedal case 8 is provided with a plurality of pedal insertion holes 8*a* into which the back portions of the plurality of pedals 10 (the right side portions in FIG. 2) are respectively inserted. As shown in FIG. 2, the inner upper surface of each pedal insertion hole 8*a* is provided with an upper limit stopper 12 for setting the upper limit position of the pedal 10. The upper limit stopper 12 is made of an elastic material such as rubber.

Figure 4:
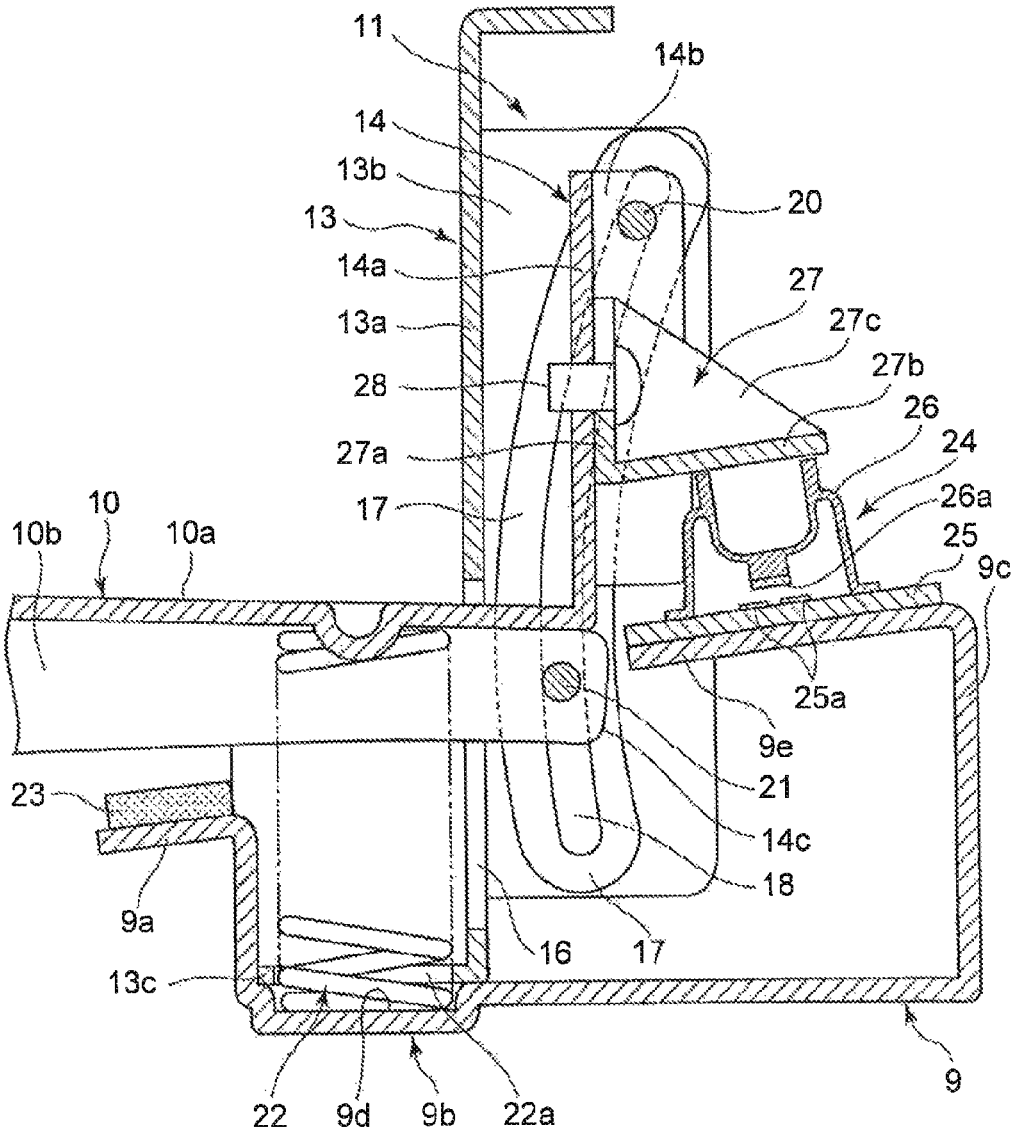
FIG. 4 is a further enlarged cross-sectional view of the main section of the pedal device shown in FIG. 2.

The pedal chassis 9 is made of a metal plate, and arranged in the lower portion of the pedal case 8 as shown in FIG. 2 to FIG. 4. That is, as shown in FIG. 3, the pedal chassis 9 is formed into a shape elongated in the left-right direction so that the plurality of pedals 10 can be arrayed in the left-right direction (the up-down direction in FIG. 3). In this instance, the pedal chassis 9 includes a first supporting section 9*a* positioned in the lower portion of the front surface of the pedal case 8 (the lower portion of the left side surface in FIG. 2), a second supporting section 9*b* positioned in the bottom portion adjacent to the back portion of the first supporting section 9*a*, and a third supporting section 9*c* positioned to the rear of the second supporting section 9*b*, as shown in FIG. 2 to FIG. 4.

That is, as shown in FIG. 2 and FIG. 4, the first supporting section 9*a* is structured such that an area corresponding to the pedal 10 bends upward along the front surface (the left side surface in FIG. 4) of the pedal case 8, and this bent upper section projects towards the front (the left side in FIG. 4) of the pedal case 8 along the bottom surface of the pedal 10. The second supporting section 9*b* is provided in the bottom portion in back (the right side in FIG. 4) of the first supporting section 9*a*. Also, a recess section 9*d* is provided in an area corresponding to the pedal 10.

As shown in FIG. 2 and FIG. 4, the third supporting section 9*c* is structured to be positioned in the back (the right side in FIG. 4) of the pedal chassis 9 and bent upward along the inner back surface of the pedal case 8. The upper end portion of this bent portion is bent and projects towards the upper portion of the back side of the pedal 10 (the upper portion of the right side in FIG. 4) at a slight downward angle towards the front (a downward angle towards the left in FIG. 4), and this projecting front end section 9*e* is formed into a comb shape.

Figure 5:
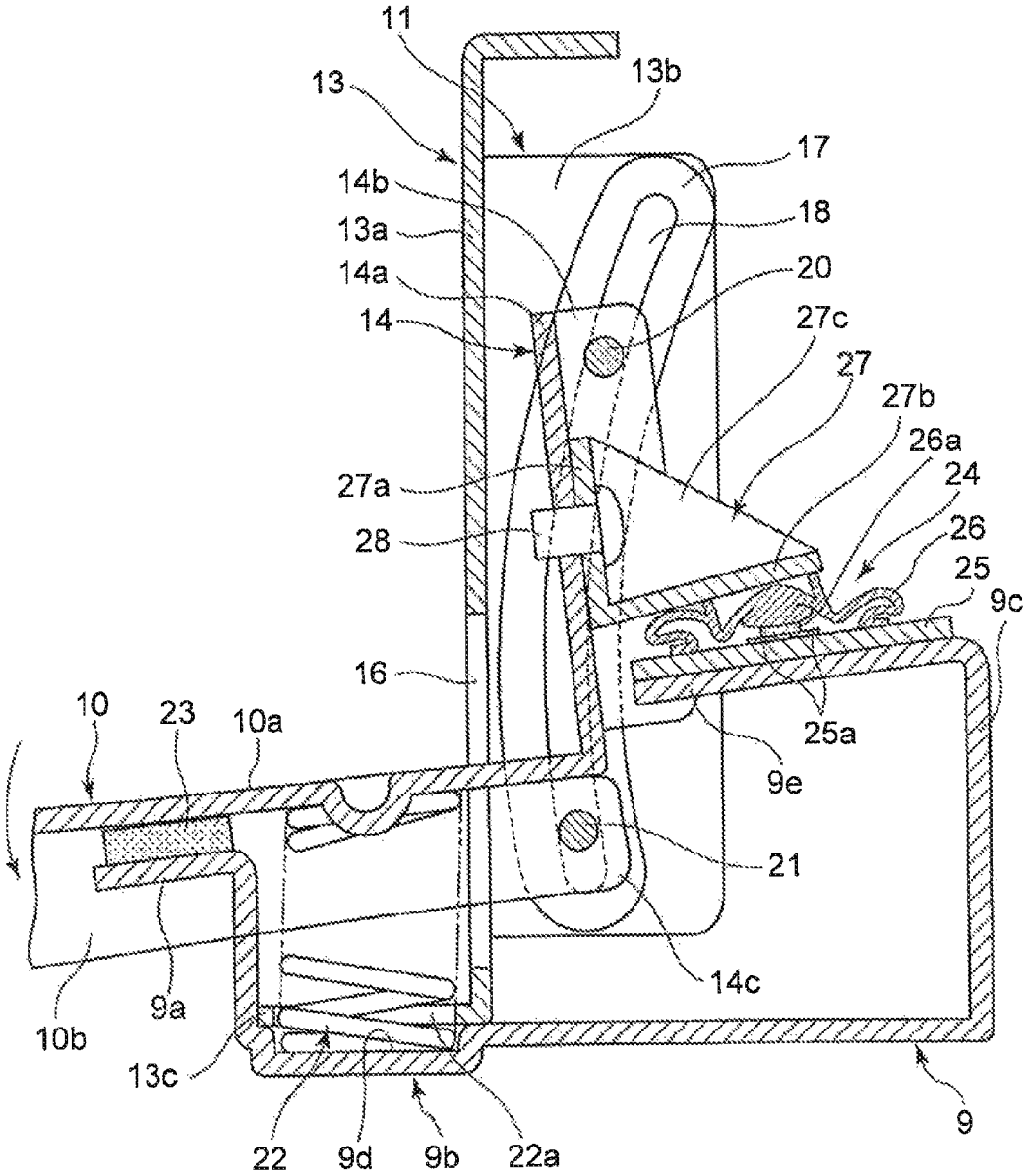
FIG. 5 is an enlarged cross-sectional view showing the main section of the pedal device shown in FIG. 4, in which the pedal is being depressed.
Figure 6:
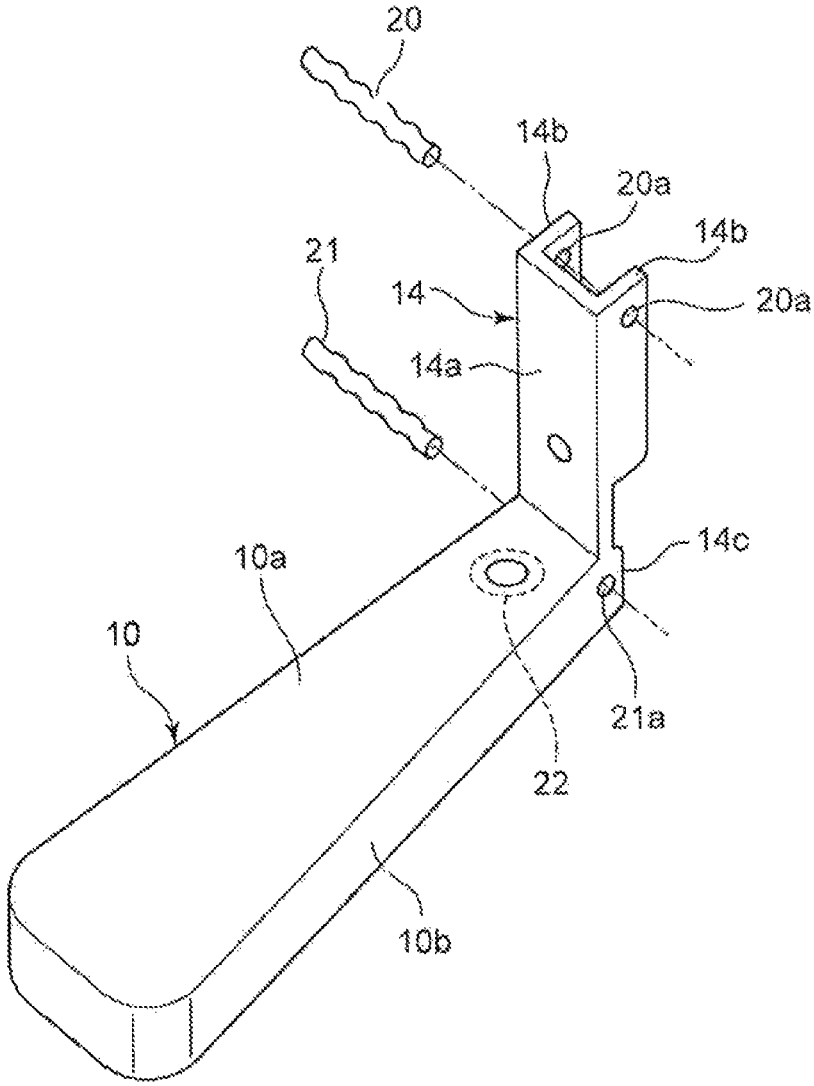
FIG. 6 is an enlarged perspective view of the pedal of the pedal device shown in FIG. 2.

As shown in FIG. 1 to FIG. 6, the plurality of pedals 10 are each formed into a shape elongated in the front-back direction (the left/right direction in FIG. 2). That is, as shown in FIG. 6, the pedals 10 are each formed such that the length (width) of the front portion (the lower left side portion in FIG. 6) of a top surface section 10*a* in the array direction is slightly longer than the length of the back portion (the upper right side portion in FIG. 6) of the top surface section 10*a* in the array direction, and a side wall section 10*b* is provided downwardly on the edge of the outer periphery of the upper surface section 10*a* to form almost a frame shape.

As shown in FIG. 2 to FIG. 5, the plurality of rotation holding mechanisms 11 respectively hold the back portion (the right side portion in FIG. 2) of the pedals 10 to the pedal chassis 9. In addition, the rotation holding mechanism 11 guides the back portion of the pedal 10 to move in the up-down direction along an arc centering on an imaginary fulcrum P that is on a rearward extension of the pedal 10 and positioned in back (to the right in FIG. 2) of the pedal chassis 9.

That is, as shown in FIG. 4 and FIG. 5, the rotation holding mechanism 11 includes a guide holding member 13 provided on the pedal chassis 9 and a guide coupling member 14 provided in the back (the right side in FIG. 4) of the pedal 10. As a result, the rotation holding mechanism section 11 is structured to guide the back portion of the pedal 10 in the up-down direction along the arc centering on the imaginary fulcrum P, in a state in which the guide coupling section 14 is held by the guide holding member 13 to be movable in the up-down direction, as shown in FIG. 2 and FIG. 4.

Figure 7:
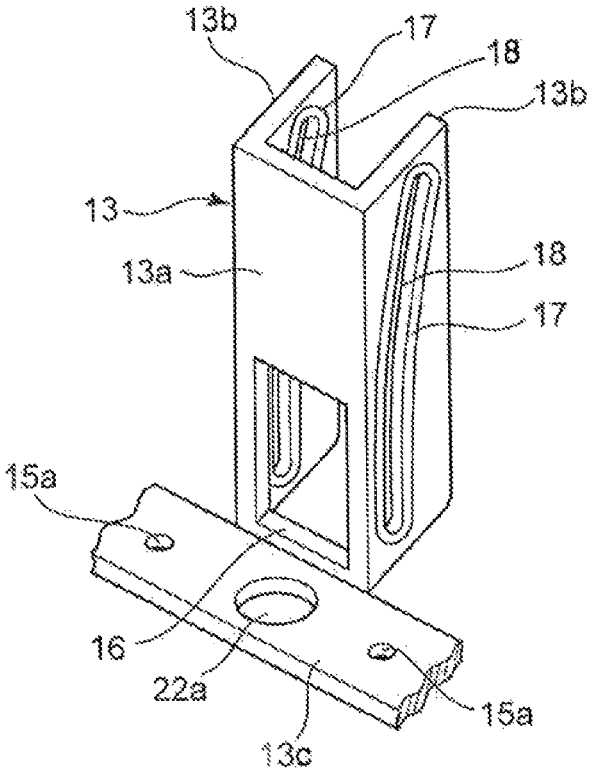
FIG. 7 is an enlarged perspective view of the pedal holding member of the pedal device shown in FIG. 2.
Figure 8:
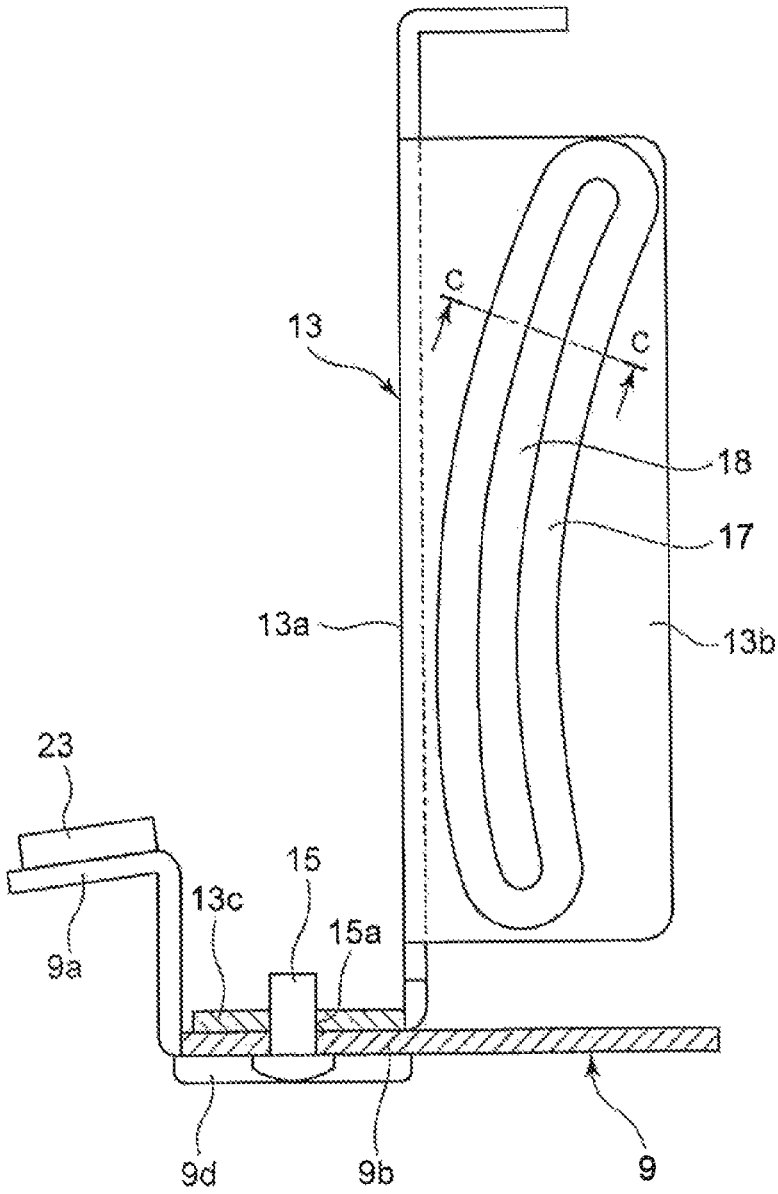
FIG. 8 is an enlarged cross-sectional view of the main section of the pedal device which has been taken along line B-B shown in FIG. 3, in which the pedal holding member has been attached to a pedal chassis.

In this instance, as shown in FIG. 7 and FIG. 8, the guide holding member 13 is structured such that both sides of a metal plate elongated in the vertical direction (the up-down direction in FIG. 8) are bent almost at a right angle towards the rear side (the right side in FIG. 8), and the lower portion is bent at almost a right angle towards the front side (the left side in FIG. 8). As a result, the guide holding member 13 has a front surface section 13*a*, a pair of side surface sections 13*b* provided on both sides of the front surface section 13*a*, and an attaching section 13*c* provided below the front surface section 13*a*, as shown in FIG. 7 and FIG. 8. The attaching section 13*c* is structured to be attached onto the second supporting section 9*b* of the pedal chassis 9.

That is, as shown in FIG. 3, FIG. 7 and FIG. 8, the attaching section 13*c* of the guide holding member 13 is formed continuously along the array direction (the up/down direction in FIG. 3) of the plurality of pedals 10. In the attaching section 13*c*, a plurality of screw holes 15*a* are respectively provided between the pedals 10, and a plurality of spring insertion holes 22*a* are provided corresponding to the pedals 10. As a result of this structure, when a screw 15 is fastened to the screw holes 15*a* from underneath the second supporting section 9*b* of the pedal chassis 9, the guide holding member 13 is attached onto the second supporting section 9*b* of the pedal chassis 9, as shown in FIG. 8.

In the front surface section 13*a* of the guide holding member 13, an opening section 16 into which the back portion of the pedal 10 is inserted is provided corresponding to the pedal insertion hole 8*a* of the pedal case 8, as shown in FIG. 2 and FIG. 7. Also, in each of the pair of side surface sections 13*b* of the guide holding member 13, a guide plate 17 made of a synthetic resin having slidability, such as polyamide (PA) that is nylon (registered trademark) or polyacetal (POM), is embedded along the up-down direction, as shown in FIG. 7 to FIG. 9.

Figure 9:
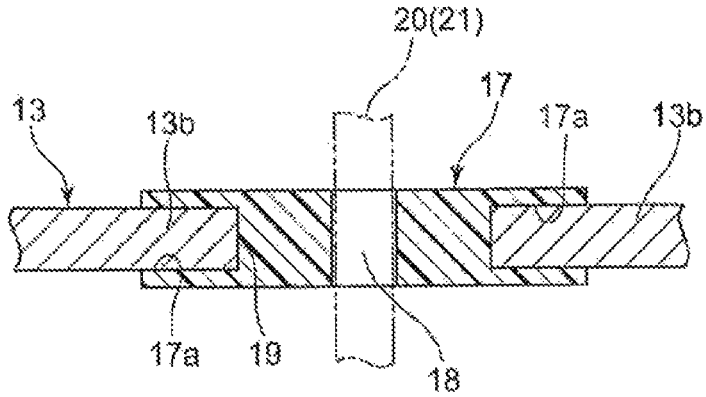
FIG. 9 is an enlarged cross-sectional view of the main section of the pedal holding member which has been taken along line C-C shown in FIG. 8.

This guide plate 17 is attached to each of the pair of side surface sections 13*b* by being fitted into a mounting groove 19 that is provided along the up-down direction of each side surface section 13*b* to form a substantially arc shape, as shown in FIG. 8 and FIG. 9. That is, the guide plate 17 is attached to each side surface section 13*b* by the edge portion of the mounting groove 19 in the side surface section 13*b* of the guide holding member 13 being inserted and fitted into a fitting groove 17*a* provided continuously along the outer peripheral portion of the guide plate 17, as shown in FIG. 9.

In the guide plate 17, a guide groove 18 is provided to curve along the up-down direction, as shown in FIG. 2. This guide groove 18 has the shape of an arc centering on the imaginary fulcrum P that is on a rearward extension of the pedal 10 and positioned in back (to the right in FIG. 2) of the pedal chassis 9. The imaginary fulcrum P is a point corresponding to the back end portion of the pedal 10 when supposing that the length of the pedal 10 in the front-back direction is formed sufficiently long, which is positioned on an imaginary line S extending posterior to the pedal 10 that is in an almost horizontal state, as shown in FIG. 2.

As shown in FIG. 4 to FIG. 6, the guide coupling member 14 has a rising section 14*a* that is provided upright on the back portion (the right side portion in FIG. 4) of the pedal 10, a pair of side sections 14*b* that is provided on both sides of the rising section 14*a* and bent towards the rear, and a back end section 14*c* provided in the back of the side wall section 10*b* of the pedal 10. As shown in FIG. 3, the guide coupling member 14 is arranged in the guide holding member 13, or in other words, between the front surface section 13*a* of the guide holding member 13 and the pair of side surface sections 13*b*, without coming into contact therewith.

That is, the rising section 14*a* of the guide coupling member 14 is formed such that its length in the up-down direction is shorter than the length of the front surface section 13*a* of the guide holding member 13 in the up-down direction, as shown in FIG. 4 to FIG. 6. In addition, the length of the rising section 14*a* in the array direction of the pedals 10 (the up-down direction in FIG. 3) is slightly shorter than the length between the side surface sections 13*b* of the guide holding member 13, as shown in FIG. 3.

Also, the pair of side sections 14*b* positioned on both sides of the guide coupling member 14 is shorter than the length of the side surface section 13*b* of the guide holding member 13 in the up-down direction, as shown in FIG. 4 to FIG. 6. In addition, its length in the front-back direction (the left-right direction in FIG. 2) is shorter than the length of the side surface section 13*b* of the guide holding member 13 in the front-back direction, as shown in FIG. 2 and FIG. 3. Also, the back end section 14*c* of the guide coupling member 14 is formed in almost the same position as the rising section 14*a*, or in other words, in the back of the side wall section 10*b* of the pedal 10 below the rising section 14*a*, as shown in FIG. 2, FIG. 4, and FIG. 5.

As a result of this structure, the guide coupling member 14 is arranged between the front surface section 13*a* of the guide holding member 13 and the pair of side surface sections 13*b* such that the rising section 14*a* faces the front surface section 13*a* of the guide holding member 13, and the pair of side sections 14*b* and the back end section 14*c* of the pedal 10 face the pair of side surface sections 13*b* of the guide holding member 13, without coming into contact therewith, as shown in FIG. 2 to FIG. 5. Also, the guide coupling member 14 is arranged such that a space is formed that is sufficient for preventing the rising section 14*a* from coming into contact with the front surface section 13*a* of the guide holding member 13 even when the pedal 10 is depressed and moved downward in a tilted state, as shown in FIG. 5.

Additionally, in the guide coupling member 14, a first guide shaft 20 and a second guide shaft 21 are attached that move within the guide groove 18 of the guide holding member 13 according to the rotational movement of the pedal 10, as shown in FIG. 2 to FIG. 6. As shown in FIG. 6, the first guide shaft 20 and the second guide shaft 21 are both spring pins. The spring pin is formed into a pipe shape, and the surface thereof is formed into a wave shape along the axial direction. These first and second guide shafts 20 and 21 are structured so as to be fixed in an arbitrary position when inserted into respective attachment holes 20*a* and 21*a* of the guide coupling member 14.

Of the first guide shaft 20 and the second guide shaft 21, the first guide shaft 20 is attached by being inserted into the attachment hole 20*a* provided in the upper portion of each of the pair of side sections 14*b* of the guide coupling member 14, as shown in FIG. 4 to FIG. 6. In this state, the end portions of the first guide shaft 20 are movably inserted into the upper portions of the guide grooves 18 of the guide plates 17 provided in the pair of side surface sections 13*b* of the guide holding member 13.

In addition, the second guide shaft 21 is attached by being inserted into the attachment hole 21*a* provided in the back end section 14*c* of the guide coupling member 14, or in other words, in the back end section 14*c* of the side wall section 10*b* of the pedal 10, as shown in FIG. 4 and FIG. 5. In this state, the end portions of the second guide shaft 21 are movably inserted into the lower portions of the guide grooves 18 of the guide plates 17 provided in the pair of side surface sections 13*b* of the guide holding member 13.

As a result, the first guide shaft 20 and the second guide shaft 21 are movably inserted into the upper and lower portions of each guide groove 18 provided in each guide plate 17 of the guide holding member 13, thereby holding the guide coupling member 14 provided on the back portion of the pedal 10 to the guide holding member 13, as shown in FIG. 4 and FIG. 5. In this state, the guide coupling member 14 is moved in the up-down direction along the arc-shaped guide grooves 18 centering on the imaginary fulcrum P, whereby the pedal 10 is rotated and moved in the up-down direction with the imaginary fulcrum P as the center.

As shown in FIG. 2 and FIG. 4, the plurality of pedals 10 are biased upwards by coil springs 20 that are biasing members. That is, the coil spring 11 is arranged between the bottom surface of the pedal 10 and the corresponding recess section 9*d* in the second supporting section 9*b* of the pedal chassis 9, through a spring insertion hole 22*a* provided in the attaching section 13*c* of the guide holding member 13. As a result of this structure, the coil spring 22 presses the pedal 10 upwards by its spring force, whereby the upper surface section 10*a* of the pedal 10 comes into elastic contact with the upper limit stopper 12 provided on the inner upper edge of the pedal insertion hole 8*a* of the pedal case 8.

As shown in FIG. 5, when each of the plurality of pedals 10 is pressed down against the spring force of the coil spring 22, the pedal 10 comes into contact with a lower limit stopper 23. As in the case of the upper limit stopper 12, this lower limit stopper 23 is made of an elastic material such as rubber, and is provided on the first supporting section 9*a* of the pedal chassis 9. As a result, when the pedal 10 is depressed, the underside of the pedal 10 comes into elastic contact with the lower limit stopper 23, whereby the lower limit position of the pedal 10 is set.

In this instance, as indicated by two-dotted chain lines in FIG. 2, the lower limit stopper 23 is structured such that, when the pedal 10 moves by rotating to the lower side and the underside of the pedal 10 comes into contact with the upper surface of the lower limit stopper 23, the lower portion of the front end of the pedal 10 comes into contact with an installation surface K, such as a floor on which the instrument case 1 has been placed, at almost the same time. As a result, even if the lower limit stopper 23 is further depressed elastically by the pedal 10 after the underside of the pedal 10 comes into contact with the upper surface of the lower limit stopper 23 and the lower portion of the front end of the pedal 10 simultaneously comes into contact with the installation surface K such as a floor on which the instrument case 1 has been placed, the back portion of the pedal 10 does not move upward with the lower limit stopper 23 as a fulcrum.

On the other hand, the third supporting section 9*c* of the pedal chassis 9 is provided with a switch section 24, as shown in FIG. 2 to FIG. 5. In this instance, as shown in FIG. 2 and FIG. 3, the third supporting section 9*c* of the pedal chassis 9 is structured such that each comb teeth portion of the angled front end section 9*e* positioned in the upper portion thereof is inserted between the pair of side sections 14*b* of the guide coupling member 14 without coming into contact therewith, and the switch section 24 is provided in this insertion area.

The switch section 24 includes a switch board 25 and a dome-shaped bulging section 26 provided on the switch board 25, as shown in FIG. 2. The switchboard 25 is provided on the third supporting section 9*c* of the pedal chassis 9 continuously along the array direction (the up-down direction in FIG. 3) of the plurality of pedals 10, as shown in FIG. 3. The dome-shaped bulging section 26 is an elastic sheet, such as rubber, formed to bulge outward, as shown in FIG. 4. In the bulging section 26, a movable contact 26*a* is provided and separably comes into contact with a fixed contact 25*a* provided on the switch board 25.

As a result, as shown in FIG. 4 and FIG. 5, the switch section 24 is structured such that, when the dome-shaped bulging section 26 is pressed from above and elastically deformed, the movable contact 26*a* provided therein comes into contact with the fixed contact 25*a* of the switch board 25, whereby the switch is operated and a switch signal is outputted. In this instance, the guide coupling member 14 is provided with a switch pressing member 27 that presses the bulging section 26 of the switch section 24 according to the rotational movement of the pedal 10 in the up-down direction, as shown in FIG. 4 and FIG. 5.

Figure 10:
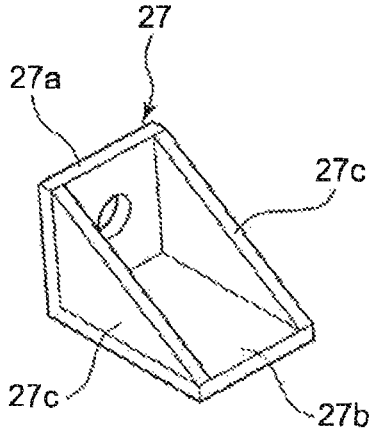
FIG. 10 is an enlarged perspective view of a switch pressing member provided in the pedal coupling member of the pedal device shown in FIG. 2.

The switch pressing member 27 includes an attaching piece 27*a* attached by a screw 28 to the inner surface of the rising section 14*a* of the guide coupling member 14*a* and a pressing piece 27*b* provided on the lower portion of the attaching piece 27*a* via reinforcement pieces 27*c*, as shown in FIG. 4 and FIG. 10. As a result, when the pedal 10 is depressed, and the first guide shaft 20 and the second guide shaft 21 move downward along the guide groove 18 of the guide holding member 13, the switch pressing member 27 moves downward with the guide coupling member 14, and the pressing piece 27*b* presses the bulging section 26 of the switch section 24, as shown in FIG. 5.

Next, the mechanism of the pedal device 7 in a keyboard instrument such as that described above will be described.

In an ordinary state where the pedal 10 has not been depressed, the pedal 10 is being pressed upward by the spring force of the coil spring 22, as shown in FIG. 2 and FIG. 4. Accordingly, the pedal 10 is positioned away from the lower limit stopper 23 in the upward direction, and is in elastic contact with the upper limit stopper 12 provided in the pedal insertion hole 8*a* of the pedal case 8. In this state, the upper limit position of the pedal 10 is being regulated.

In addition, because the back portion of the pedal 10 is also being pressed upward, the guide coupling member 14 is positioned on the inner upper side of the guide holding member 13 in an almost vertical state, as shown in FIG. 2 and FIG. 4. At this time, as a result of the first guide shaft 20 and the second guide shaft 21 being in their upper positions, the first guide shaft 20 is positioned near the upper end of the guide grooves 18 of the guide holding member 13, and the second guide shaft 21 is positioned away from the lower end of the guide grooves 18 of the guide holding member 13 in the upward direction.

Moreover, the switch pressing member 27 provided on the guide coupling member 14 has been moved upward with respect to the switch section 24, as shown in FIG. 4. Therefore, the bulging section 26 of the switch section 24 has been bulged in a dome-shape as a result of elastic return, and the movable contact 26*a* inside the bulging section 26 has been separated from the fixed contact 25*a* of the switch board 25, whereby the switch section 24 has been turned OFF.

In this state, when the front portion (the left side portion in FIG. 2) of the pedal 10 is depressed against the spring force of the coil spring 22, the pedal 10 is moved by being rotated downwards. At this time, because the pedal 10 moves downward while compressing the coil spring 22, the guide coupling member 14 provided in the back portion of the pedal 10 moves downward along with it, as shown in FIG. 5. In addition, the first guide shaft 20 and the second guide shaft 21 move downward along the guide grooves 18 of the guide holding member 13, along with the movement of the guide coupling member 14.

That is, since the guide grooves 18 has the shape of an arc centering on the imaginary fulcrum P that is on a rearward extension of the pedal 10 and positioned in back of the pedal chassis 9 as shown in FIG. 2, the first guide shaft 20 and the second guide shaft 21 move downward along the guide grooves 18. As a result, the overall pedal 10 moves by rotating around the imaginary fulcrum P.

At this time, the back portion of the pedal 10 moves downward with the first guide shaft 20 and the second guide shaft 21, and also the front portion of the pedal 10 moves downward, as shown in FIG. 5. Therefore, even when the length of the pedal 10 in the front-back direction is shortened, the same rotational movement as that of when the length of the pedal 10 in the front-back direction is formed longer to reach the imaginary fulcrum P is performed. As a result, the rotation angle of the pedal 10 is reduced.

As just described, when the pedal 10 moves by rotating downwards, the guide coupling member 14 also moves downward along with it, whereby the switch pressing member 27 provided in the guide coupling member 14 presses the switch section 24. As a result, the bulging section 26 of the switch section 24 is elastically deformed, and the contact point 26*a* therein comes into contact with the fixed contact 25*a* of the switch board 25, whereby the switch of the switch section 24 is operated and a switch signal is outputted.

Then, when the pedal 10 moves by rotating further downward, the underside of the pedal 10 comes into elastic contact with the lower limit stopper 23 provided on the first supporting section 9*a* of the pedal chassis 9, whereby the lower limit position of the pedal 10 is set. As indicated by the two-dotted chain lines in FIG. 2, when the underside of the pedal 10 comes into contact with the upper surface of the lower limit stopper 23, the lower portion of the front end of the pedal 10 comes into contact with the installation surface K, such as a floor on which the instrument case 1 has been placed, at almost the same time.

In this state, when the pedal 10 is further depressed, the lower limit stopper 23 is elastically pressed downward by the pedal 10. At this time, since the lower portion of the front end of the pedal 10 is in contact with the installation surface K, the pedal 10 rotates with the lower portion of the front end of the pedal 10, which is in contact with the installation surface K, as the center. Therefore, the back portion of the pedal 10 does not move upwards as a result of the pedal 10 rotating with the lower limit stopper 23 as the fulcrum.

In this state, when the player takes his or her foot off the pedal 10 and the external force is released thereby, the pedal 10 is pressed upward by the spring force of the coil spring 22 and returns to its initial position. At this time as well, because the first guide shaft 20 and the second guide shaft 21 move upwards along the guide grooves 18 having the shape of an arc centering on the imaginary fulcrum P that is on a rearward extension of the pedal 10 and positioned in back of the pedal chassis 9, the overall pedal 10 moves upward by rotating around the imaginary fulcrum P.

In addition, because the guide coupling member 14 also moves upward along with it, the switch pressing member 27 provided on the guide coupling member 14 moves upward away from the switch section 24, and the switch section 24 is turned OFF. Then, the pedal 10 moves further upwards, and the upper surface section 10*a* of the pedal 10 comes into elastic contact with the upper limit stopper 12 provided in the pedal insertion hole 8*a* of the pedal case 8, whereby the pedal 10 is set in the upper limit position and returns to its initial position.

As described above, the pedal device 7 includes the pedal chassis 9 provided in the pedal case 8, the pedal 10 that moves by rotating in the up-down direction in relation to the pedal chassis 9, and the rotation holding mechanism 11 that holds the back portion of the pedal 10 such that it can move in the up-down direction with respect to the pedal chassis 9. Therefore, even when the pedal 10 is shortened and the installation space of the overall instrument is reduced, an uncomfortable operational feeling is not created during the depressing operation of the pedal 10 and pedaling operations can be performed comfortably.

That is, when the pedal 10 of this pedal device 7 is depressed, the back portion of the pedal 10 is moved downward by the rotation holding mechanism 11, according to the rotational movement of the pedal 10. Therefore, even when the length of the pedal 10 in the front-back direction is shortened, the rotation angle of the pedal 10 can be reduced because the overall pedal 10 moves downward. As a result, the pedal 10 can be shortened and the installation space of the overall instrument can be reduced. In addition, even when the pedal 10 is shortened, an uncomfortable operational feeling is not created during the depressing operation of the pedal 10 and pedaling operations can be performed comfortably.

In this instance, since the rotation holding mechanism 11 is structured to guide the back portion of the pedal 10 to move in the up-down direction along an arc centering on the imaginary fulcrum P positioned on a rearward extension of the pedal 10, the pedal 10 can be rotated in the up-down direction, centering on the imaginary fulcrum P positioned on a rearward extension of pedal 10. Therefore, even when the length of the pedal 10 in the front-back direction is shortened, pedal operation similar to that of a typical pedal whose length in the front-back direction is long can be performed. As a result, an uncomfortable operational feeling is not created during the depressing operation of the pedal 10 and pedaling operations can be performed more comfortably.

In addition, the rotation holding mechanism 11 includes the guide holding member 13 provided in the pedal chassis 9 and the guide coupling member 14 provided in the back portion of the pedal 10. The guide holding member 13 has therein the guide grooves 18 having the shape of an arc centering on the imaginary fulcrum P positioned on a rearward extension of the pedal 10, along the up-down direction. The guide coupling member 14 has the first guide shaft 20 and the second guide shaft 21 that move within the guide grooves 10 of the guide holding member 13 according to the rotational movement of the pedal 10. As a result, the guide coupling member 14 provided in the pedal 10 can be coupled with the guide holding member 13 provided in the pedal chassis 9 by the first guide shaft 20 and the second guide shaft 21 so as to move in the up-down direction.

Accordingly, in the rotation holding member 11, when the pedal 10 moves by rotating in the up-down direction, the first guide shaft 20 and the second guide shaft 21 move along the guide grooves 18 having the shape of an arc centering on the imaginary fulcrum P that is on a rearward extension of the pedal 10 and positioned in back of the pedal chassis 9. As a result, the overall pedal 10 moves by rotating around the imaginary fulcrum P. Therefore, even when the length of the pedal 10 in the front-back direction is shortened, the rotation angle of the pedal 10 can be reduced, whereby an uncomfortable operational feeling is not created during the depressing operation of the pedal 10 and pedaling operations can be performed comfortably.

That is, since the back portion of the pedal 10 moves downward with the first guide shaft 20 and the second guide shaft 21, and the front portion of the pedal 10 moves downward along with it, the same rotational movement as that of when the length of the pedal 10 in the front-back direction is formed longer to reach the imaginary fulcrum. P is performed even when the length of the pedal 10 in the front-back direction is shortened, and therefore the rotation angle of the pedal 10 can be reduced without any problem. Accordingly, even when the pedal 10 is shortened, pedal operation similar to that of a typical pedal whose length in the front-back direction is long can be performed without an uncomfortable operational feeling being created during the depressing operation of the pedal 10, whereby pedaling operations can be performed comfortably.

In this instance, the guide grooves 18 are formed in the synthetic resin guide plate 17 having slidability which is provided in the guide holding member 13. Therefore, when moving within the guide grooves 18 according to the rotational movement of the pedal 10, the first guide shaft 20 and the second guide shaft 21 can smoothly and unfailingly slide by the slidability of the guide plate 17, whereby the depression operability of the pedal 10 can be improved.

In addition, the pedal device 7 includes the spring coil 22 as a biasing member that constantly biases the pedal 10 upwards. As a result, the pedal 10 can always be pressed upwards to a predetermined position (upper limit position) when the pedal 10 is not being operated. Therefore, when depressing force is released after the pedal 10 is depressed against the spring force of the coil spring 22 and moved downward by being rotated around the imaginary fulcrum P, the pedal 10 can automatically return to its original predetermined position by being pressed upwards by the spring force of the coil spring 22.

In this instance, the pedal case 8 is provided with the upper limit stopper 12 that elastically sets the upper limit position of the pedal 10. Therefore, when the pedal 10 is pressed upwards by the spring force of the coil spring 22, the upper limit position of the pedal can be regulated by the upper limit stopper 12. In addition, this upper limit stopper 12 is made of an elastic material such as rubber, and so the pedal 10 comes into contact with the upper limit stopper 12 elastically. Therefore, abnormal noise does not occur, whereby pedaling operations can be performed comfortably.

In addition, the pedal device 7 includes the lower limit stopper 23 that elastically sets the lower limit position of the pedal 10. Therefore, when the pedal 10 is depressed and moved downward by being rotated around the imaginary fulcrum P, the pedal 10 can be regulated to be stopped at the lower limit position. In addition, the lower limit stopper 23 is made of an elastic material such as rubber, and so the pedal 10 comes into contact with the lower limit stopper 23 elastically.

Therefore, abnormal noise does not occur, whereby pedaling operations can be performed comfortably.

In this instance, when the pedal 10 is depressed and comes into contact with the lower limit stopper 23, the lower portion on the front end of the pedal 10 comes into contact with the installation surface K on which the instrument case 1 has been installed. As a result of the lower limit stopper 23 being elastically pressed downward by the pedal 10 in this state, the underside of the pedal 10 comes into contact with the upper surface of the lower limit stopper 23 and, at almost the same time, the lower portion of the front end of the pedal 10 comes into contact with the installation surface K which is the floor on which the instrument case 1 has been placed.

Therefore, when the lower limit stopper 23 is elastically pressed downward by the pedal 10, since the lower portion of the front end of the pedal 10 is in contact with the installation surface K, the pedal 10 rotates with the lower portion of the front end of the pedal 10, which is in contact with the installation surface K, as the center. Therefore, the back portion of the pedal 10 does not move upwards as a result of the pedal 10 rotating with the lower limit stopper 23 as the fulcrum, whereby the pedal operability can be can be improved.

Moreover, the pedal device 7 includes the switch section 24 that operates the switch according to the rotational movement of the pedal 10. Therefore, musical tone can be successfully controlled according to the depressing operation of the pedal 10. In this instance, the guide coupling member 14 is provided with the switch pressing member 27 that presses the switch section 24 according to the rotational movement of the pedal 10. Therefore, when the pedal 10 is depressed, the switch section 24 is unfailingly and successfully pressed by the switch pressing member 27 for the operation of the switch.

In the above-described embodiment, the guide grooves 18 of the guide holding member 13 are formed into the shape of an arc centering on the imaginary fulcrum positioned on a rearward extension of the pedal 10. However, the guide grooves 18 are not necessarily required to be arc-shaped, and may be formed in an almost vertical straight line, or a straight line or a curved line angled in the vertical direction.

Moreover, in the above-described embodiment, the coil spring 22 is used as the biasing member that presses the pedal 10 upward. However, the coil spring 22 is not necessarily required to be used, and a flat spring, a torsion spring coil, or an elastic member such as rubber may be used instead thereof.

Furthermore, of the first guide shaft 20 and the second guide shaft 21 that are attached to the guide coupling member 14 and move within the guide grooves 18 of the guide holding member 13, the second guide shaft 21 is attached to the back end section 14*c* of the side wall section 10*b* of the pedal 10 which is the guide coupling member 14. However, the structure is not limited thereto, and the second guide shaft 21 may be attached to the lower portion of the pair of side sections 14*b* of the guide coupling member 14.

While the present invention has been described with reference to the preferred embodiments, it is intended that the invention be not limited by any of the details of the description therein but includes all the embodiments which fall within the scope of the appended claims.

What is claimed is:

1. A pedal device comprising:

a pedal that moves by rotating in an up-down direction with respect to an instrument main body; and a rotation holding mechanism that holds a back portion of the pedal to the instrument main body such that the back portion of the pedal is movable in the up-down direction;

wherein the rotation holding mechanism guides the back portion of the pedal to move in the up-down direction along an arc centering on an imaginary fulcrum positioned on a rearward extension of the pedal.

2. The pedal device according to claim 1, wherein the rotation holding mechanism includes:

a guide holding member which is provided in the instrument main body and in which a guide groove having a shape of an arc centering on the imaginary fulcrum positioned on the rearward extension of the pedal is provided along the up-down direction, and a guide coupling member which is provided in the back portion of the pedal and has a plurality of guide shafts that move within the guide groove of the guide holding member according to a rotational movement of the pedal.

3. The pedal device according to claim 2, wherein the guide groove is formed in a guide plate made of synthetic resin having slidability which is provided in the guide holding member.

4. The pedal device according to claim 1, further comprising a biasing member for constantly biasing the pedal upwards.

5. The pedal device according to claim 1, further comprising a lower limit stopper that elastically sets a lower limit position of the pedal.

6. The pedal device according to claim 5, wherein the lower limit stopper is elastically pressed downward by the pedal, and a lower portion of a front end of the pedal comes into contact with an installation surface of the instrument main body, when the pedal is depressed and comes into contact with the lower limit stopper.

* * * * *